US008588441B2

(12) United States Patent
Kramer et al.

(10) Patent No.: US 8,588,441 B2
(45) Date of Patent: Nov. 19, 2013

(54) METHOD FOR ADAPTIVELY MATCHING MICROPHONES OF A HEARING SYSTEM AS WELL AS A HEARING SYSTEM

(75) Inventors: Michael Kramer, Urbana, IL (US); Hans-Ueli Roeck, Hombrechtikon (CH)

(73) Assignee: Phonak AG, Stafa (CH)

( * ) Notice: Subject to any disclaimer, the term of this patent is extended or adjusted under 35 U.S.C. 154(b) by 966 days.

(21) Appl. No.: 12/696,110

(22) Filed: Jan. 29, 2010

(65) Prior Publication Data

US 2011/0188681 A1 Aug. 4, 2011

(51) Int. Cl.
*H04R 25/00* (2006.01)

(52) U.S. Cl.
USPC ..... 381/313; 381/312; 381/316; 381/320

(58) Field of Classification Search
USPC ..... 381/312–313, 316–318, 320–321
See application file for complete search history.

(56) References Cited

U.S. PATENT DOCUMENTS

| | | | |
|---|---|---|---|
| 5,029,215 | A | 7/1991 | Miller |
| 6,272,229 | B1 | 8/2001 | Baekgaard |
| 6,385,323 | B1 | 5/2002 | Zoels |
| 7,027,607 | B2 | 4/2006 | Pedersen et al. |
| 7,155,019 | B2 | 12/2006 | Hou |
| 7,346,176 | B1 | 3/2008 | Bernardi et al. |
| 2003/0142836 | A1 | 7/2003 | Warren et al. |
| 2005/0244018 | A1 | 11/2005 | Fischer et al. |
| 2007/0183610 | A1 | 8/2007 | Kidmose |
| 2007/0258597 | A1 | 11/2007 | Rasmussen et al. |

FOREIGN PATENT DOCUMENTS

| | | | |
|---|---|---|---|
| EP | 1489883 | A2 | 12/2004 |

OTHER PUBLICATIONS

European Search Report for 10 15 9667 dated Apr. 5, 2011.

*Primary Examiner* — Suhan Ni
(74) *Attorney, Agent, or Firm* — Pearne & Gordon LLP

(57) ABSTRACT

A method and a hearing system for adaptively matching microphones (3, 4) of a hearing system. The method comprising the steps of determining a true direction towards a sound source, determining an estimated direction towards the sound source using microphones (3, 4) of the hearing system, comparing the true direction with the estimated direction to obtain a correction factor, applying the correction factor to the signals of the microphones (3, 4) of the hearing system in order to reduce a difference between the true direction and a corrected estimated direction obtained via corrected microphone signals.

19 Claims, 2 Drawing Sheets

METHOD FOR ADAPTIVELY MATCHING MICROPHONES OF A HEARING SYSTEM AS WELL AS A HEARING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACK GROUND OF THE INVENTION (1) Field of the Invention

The present invention is related to a method for adaptively matching microphones of a hearing system as well as to a hearing system.

(2) Description of Related Art Including Information Disclosed Under 37 CFR 1.97 and 1.98

Not Applicable

BRIEF SUMMARY OF THE INVENTION

Hearing systems utilize two microphones to do beamforming. Beamforming is known as a very effective way to improve speech intelligibility for hearing impaired persons wearing a hearing system. To enable effective beamforming, the microphones resp. the signal paths up to a beamformer processing unit have to be well matched in phase and magnitude over the frequency range of interest.

Unfortunately, the available microphones are not sufficiently matched in phase to achieve a satisfactory beamforming performance at low frequencies without further matching methods. Common deviations are up to 80 μs group delay difference at low frequencies, i.e. at 100 Hz. In order to obtain a satisfactory result when using a beamformer, the group delay difference must be below 10 μs, preferably even below 5 μs.

Known methods that try to improve a beamformer algorithm by microphone matching use a standard procedure or a model of a possible error situation. Wrong assumption for the model or insufficient models result in an imprecise beamformer.

In this connection, reference is made to U.S. Pat. No. 7,027,607, U.S. Pat. No. 7,155,019, U.S. Pat. No. 6,385,323, US-2007/0183610 A1, US-2007/0258597 A1, US-2005/0244018 A1 and U.S. Pat. No. 6,272,229.

Therefore, it is one object of the present invention to provide a method for matching microphones that does at least not have one of the disadvantages of known solutions.

The present invention is defined by the steps of claim 1. Further embodiments as well as a hearing system are defined in further claims.

The present invention is first directed to a method for adaptively matching microphones of a hearing system, the method comprising the steps of:

determining a true direction towards a sound source, determining an estimated direction towards the sound source using microphones of the hearing system, comparing the true direction with the estimated direction to obtain a correction factor, applying the correction factor to the signals of the microphones of the hearing system in order to reduce a difference between the true direction and a corrected estimated direction obtained via corrected microphone signals.

Thereby, the performance of the beamformer can be improved to a large extent. This is in particular true with regard to the low frequency behavior of the beamformer. In addition, static calibration methods to match the microphones in production or during the fitting process can be avoided.

In an embodiment of the method according to the present invention, the step of determining the true direction comprises limiting a first frequency range to a section in which a good matching of the microphones is expected, the first frequency range being in particular above 1 kHz.

In further embodiments of the method according to the present invention, the step of determining an estimated direction comprises limiting a second frequency range to a section in which the matching of the microphones is to be improved, the second frequency range being in particular below 1 kHz.

In further embodiments of the method according to the present invention, the hearing system comprises a single hearing device with at least two microphones to be matched.

In still further embodiments of the method according to the present invention, the hearing system comprises a binaural hearing device with at least two microphones to be matched, and wherein an ipsi-lateral microphone and a co-lateral microphone are used in the step of determining the true direction.

In further embodiments of the method according to the present invention, two ipsi-lateral microphones are used in the step of determining an estimated direction.

Further embodiments of the method according to the present invention further comprise the step of checking whether a single sound source is present, particularly having at least a predefined signal-to-noise ratio.

In further embodiments of the method according to the present invention, a speech detector is used to determine whether a single broadband sound source is present. With the speech detector, a single sound source can easily be determined. Such a sound source is sufficiently broadband and originates from a single location. Therefore, it can very be used for adapting the microphones.

In still further embodiments of the method according to the present invention, all steps are performed during regular operation of the hearing system.

Furthermore, the present invention is directed to a hearing system comprising:

at least two microphones generating input signals, means for determining a true direction towards a sound source, means for determining an estimated direction towards the sound source using at least two of the at least two microphones, means for comparing the true direction with the estimated direction to obtain a correction factor, means for applying the correction factor to the input signals of the microphones in order to reduce a difference between the true direction and a corrected estimated direction obtained via corrected input signals.

In an embodiment of the hearing system according to the present invention, the means for determining the true direction comprise frequency limiting means for limiting a first frequency range to a section in which a good matching of the microphones is expected, the first frequency range being in particular above 1 kHz.

In further embodiments of the hearing system according to the present invention, the means for determining the estimated direction comprise frequency limiting means for limiting a second frequency range to a section in which the matching of the microphones is to be improved, the second frequency range being in particular below 1 kHz.

Further embodiments of the hearing system according to the present invention comprise a single hearing device with at least two microphones to be matched.

Further embodiments of the hearing system according to the present invention comprise a binaural hearing device with at least two microphones (3, 4, 5, 6) to be matched, an ipsi-lateral microphone (3, 4) and a co-lateral microphone (5, 6) are used to determine the true direction (tDOA).

Further embodiments of the hearing system according to the present invention comprise two ipsi-lateral microphones to determine the estimated direction.

Still further embodiments of the hearing system according to the present invention further comprise means for checking whether a single sound source is present, particularly having at least a predefined signal-to-noise ratio.

Further embodiments of the hearing system according to the present invention comprise a speech detector is used to determine whether a single broadband sound source is present.

It is pointed out that the present invention is directed to every possible combination of the above-mentioned embodiments. Only those combinations are excluded which would result in a contradiction.

The present invention will be further described in the following by referring to drawings showing exemplified embodiments of the present invention.

DETAILED DESCRIPTION OF THE INVENTION

Figure 1:
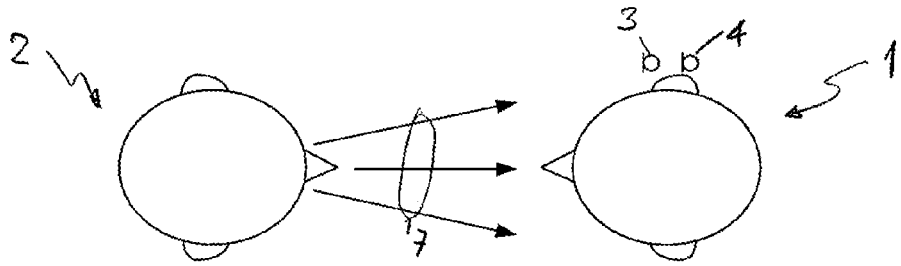
FIG. 1 shows a situation with a hearing system user wearing a hearing device in one ear and a person as a single sound source.

FIG. 1 shows a common situation which is suitable to perform a microphone matching according to the present invention. The situation is characterized in that a hearing system user 1 is confronted with a single sound source 2. The single sound source 2 is a person speaking to the hearing system user 1. The hearing system user 1 wears a hearing device in one of his ears—also known as monaural hearing system—, the hearing device comprising two microphones 3 and 4. The microphones 3 and 4 or a signal path up to a beamformer, respectively, have to be matched in phase and magnitude over a frequency range of interest to enable effective and accurate beamforming. Thereby, it has been shown that a phase matching is particularly important for lower frequencies, i.e. for frequencies below 1 kHz, for example, than for higher frequencies, i.e. for frequencies above 1 kHz, for example. Since microphones are usually sufficiently well matched by the manufacturer above approximately 1 kHz, phase matching for the microphones 3 and 4 can be reduced to a frequency range below 1 kHz.

In a first embodiment, the present invention makes use of the knowledge that the two microphones 3 and 4 are well matched in a first frequency range, e.g. frequencies above 1 kHz. Whenever a single sound source 2 is present having a sufficiently broad spectrum, i.e. a frequency range that encompasses at least a section of the first frequency range as well as a second frequency range, in which microphone matching must be performed, a true direction tDOA of the sound source 2 in relation to the position of the hearing system user 1 can be determined in the first frequency range. Due to the fact that the microphones 3 and 4 are well matched in the first frequency range, the true direction tDOA determined in this first frequency range can be regarded as precise.

In a further step, an estimated direction eDOA is determined in the second frequency range using the same microphones 3 and 4. Provided that the sound source 2 is still at the same location, a correction factor $\alpha$ is obtained by comparing the true direction tDOA and the estimated direction eDOA, the correction factor $\alpha$ being a measure of how well the microphones 3 and 4 are matched in the second frequency range. By applying the correction factor $\alpha$ in the signal path between the microphones 3, 4 and a beamforming unit in the second frequency range, the microphones 3 and 4 can be regarded as sufficiently matched over the entire frequency range.

In a further embodiment of the present invention, it is checked whether a single sound source 2 is present in order to obtain improved matching results for the microphones 3 and 4. Thereby, the following criterions must be fulfilled:

The sound source 2 must be broadband, i.e. at least covering a section of the first frequency range as well as a section of the second frequency range; and The signal-to-noise-(SNR) ratio must be sufficiently high over the background noise.

Speech in a quiet surrounding is a sound source 2 that fulfills the requirement of being sufficiently broadband and, in addition, has a sufficiently high signal-to-noise or SNR ratio over the background noise. Therefore, and in a further embodiment of the present invention, a speech detector is applied that is used to detect this favorable sound source for the matching process. Speech detectors are well known in the art and are known to be reliable. Once a speech detector has detected a single speech source as sound source 2, the true direction tDOA is determined at mid frequencies, i.e. in the first frequency range defined by 1 to 4 kHz, for example. From knowing that this sound source 2 originates from a single source, namely the mouth of the person speaking, it can be inferred that the incoming sound energy at lower frequencies, i.e. in the second frequency range, comes from the same direction, namely the true direction tDOA. The effectively measured estimated direction eDOA in the second frequency range can now get corrected by the correction factor $\alpha$ leading to the same direction as measured in the first frequency range. The correction itself can be performed by applying a suitable filter in time domain or frequency domain in front of a beamformer or within the beamformer itself or before/within any signal processing algorithm being sensitive to phase mismatching of the input sources. Such algorithms include source localization methods, for example, utilizing a cross correlation or mutual time delay of the microphone signals, respectively.

In the following, an example is given for a monaural hearing system with a microphone distance of 10 mm. In case a sound source 2—e.g. a speech source—is detected in the first frequency range with a true direction tDOA of 0°. A signal arrival delay between the microphones 3 and 4 is obtained by $$\frac{10\ \text{mm}}{340\ \text{m/s}} = 29\ \mu\text{s}$$

The same sound source 2 is detected in the second frequency range, e.g. at 300 Hz with a time delay of 44 μs. A corresponding correction factor α of 44 μs−29 μs=15 μs bias time delay has to get applied to the front microphone in this frequency band. Such a bias time delay corresponds to a phase shift of approximately 1.6° at 300 Hz. This phase shift can now get implemented with an allpass filter, in the frequency domain by multiplication of the audio signal with a complex exponential function or with another suitable filter. If the measured arrival delay is smaller than 29 μs, the corresponding correction factor α may get applied on the back microphone signal.

Figure 2:
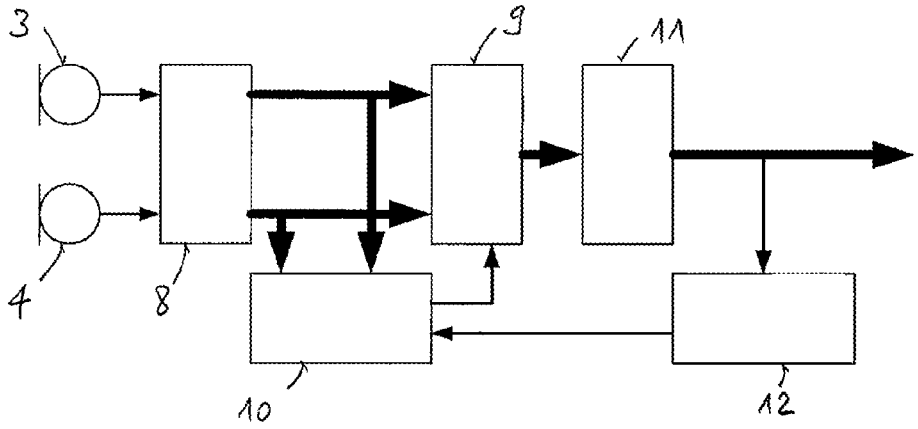
FIG. 2 shows a schematic block diagram of an input section of the hearing device used by the hearing system user of FIG. 1.

The above-mentioned processing steps are further described by referring to FIG. 2 showing a block diagram of a front end of the monaural hearing system worn by the hearing system user 1 of FIG. 1. Output signals of the microphones 3 and 4 are fed to a frequency separation unit 8, in which the audio signals are separated into different frequency bands. After the frequency separation unit 8, fat lines indicate vectors of frequency band separated signals. The information of the frequency separation unit 8 is fed to a correction unit 9 as well as to a adapting unit 10, in which the correction factor α is determined as has already been described. The correction factor α is fed to the correction unit 9 in order that a possible mismatching of the microphones 3 and 4 can be corrected in the second frequency range before a beamformer algorithm is applied in the beamformer unit 11 to obtain directional information that is later processed in a signal processing unit (not shown in FIG. 2). Furthermore, a front/back detector unit 12 is provided that is used to generate information whether a sound source 2 is in the front or in the back of the hearing device user 1 (FIG. 1). This information is important for the adapting unit 10 and must therefore be taken into account while determining the correction factor α.

It is clear to the skilled in the art that the block diagram of FIG. 2 can be changed without departing from the concept of the present invention. For example, the adapting unit 10 to determine the true or estimated direction tDOA or eDOA can be placed after the correction unit 9 or act in a feedback fashion.

The frequency band separation in the frequency separation unit 8 can be done by time domain filters, a Fourier transform (FFT) or other suitable methods. Similarly, the level and phase matching in the correction unit 9 as well as the beamforming algorithm in the beamformer unit 11 can be performed in time domain or in frequency domain.

Figure 3:
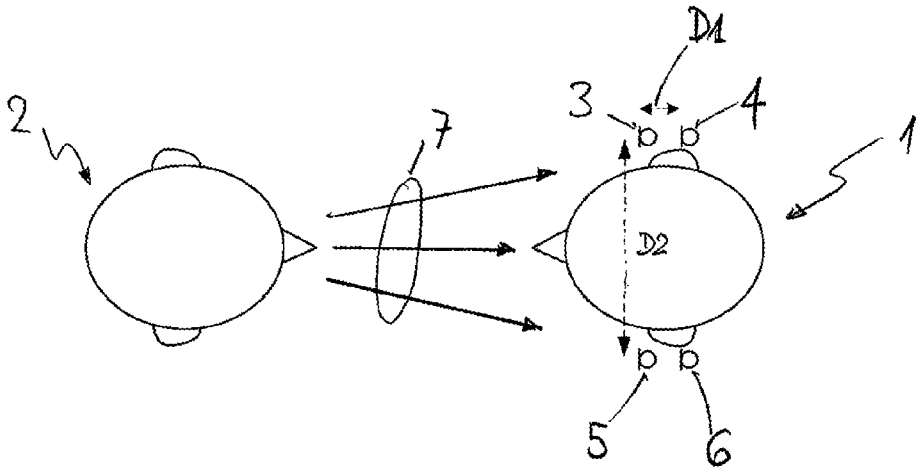
FIG. 3 shows a situation with a hearing system user wearing a binaural hearing device and the sound source of FIG. 1.

FIG. 3 again shows a common situation as has already been presented in connection with FIG. 1 and the monaural hearing system. FIG. 3 now refers to a binaural hearing system that comprises a left and a right hearing device with its microphones 3, 4 and 5, 6, respectively. As the microphone distance is significantly larger than for a single hearing device, i.e. for a monaural hearing system, the effect of phase mismatching is also significantly less severe on localization errors. While a distance D1 between the microphones 3 and 4 of the same hearing device is approximately 10 mm, a distance D2 between microphones 3, 5 and 4, 6, respectively, is approximately 170 mm. This means that with help of two binaural microphone signals which are not phase matched, one can determine a true direction tDOA from a sound source 2 in front of the hearing system user 1 up to approx. ±10° of the true direction at low frequencies. This can be done for each time-frequency slot.

Thus, by utilizing the contra-lateral microphone 3, 5 and 4, 6, respectively, the hearing system computes the location of the sound source 2 for each frequency band of interest (e.g. for all bands<1 kHz) and each time slot. If a sound source 2 is present in front of the hearing system user 1, i.e. at 0°±10° than the monaural phase matching algorithm is computed with the knowledge of the known true direction tDOA. The time constant of the actual phase matching algorithm can still be slow, i.e. in the order of hours or even days to account for the slow changes in phase matching without introducing unwanted oscillations. Thus, such measurement or correction values can also get stored in a non-volatile memory and used as initialization values after initializing or boot-up of the hearing system.

Figure 4:
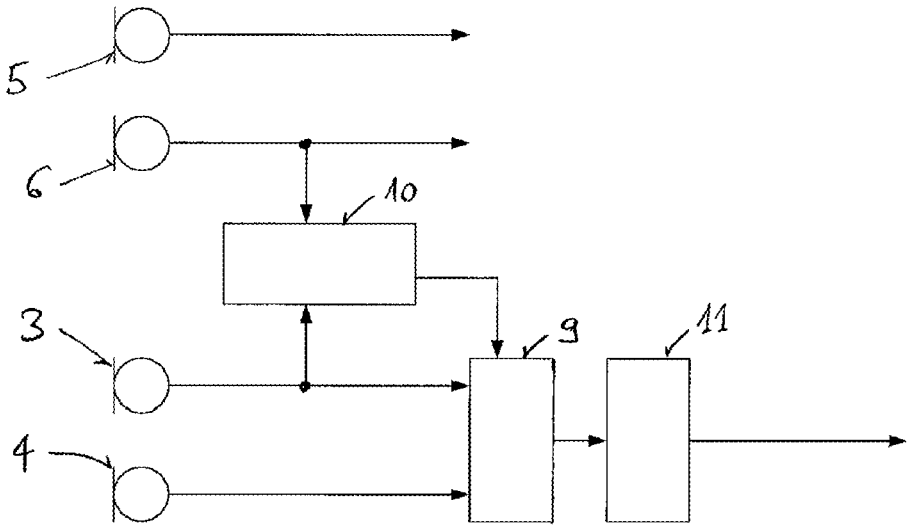
FIG. 4 shows a schematic block diagram of an input section of the binaural hearing device used by the hearing system user of FIG. 3.

The above-mentioned processing steps are further described by referring to FIG. 4 showing a schematic block diagram of a front end of the binaural hearing system worn by the hearing system user 1 of FIG. 3. The microphones 3 and 4, which shall be matched, are fed to a correction unit 9, in which the signals of the microphones 3, 4 are corrected in order that an accurate result can be obtained by the beamformer algorithm implemented in the beamformer unit 11 that follows the correction unit 9 down the signal path. In contrast to the embodiment according to FIG. 2, the adapting unit 10 of FIG. 4 now receives input signals of a contra-lateral microphone 5 and the ipsi-lateral microphone 4. As explained above, the contra-lateral microphone 5 is—due to its distance D2 to the ipsi-lateral microphone 4—better suited for determining the true direction tDOA of a sound source 2.

It is to be noted that in the method used in connection with monaural hearing systems as well as in the method used in connection with binaural hearing systems, the beamforming may contain a forward looking cardioid (with a null direction towards 180°) and a blocking matrix (backward facing cardioid) with a null direction towards 0°.

Due to local effects of wearing a beamformer close to the head of the hearing system user, the microphone signals for the forward looking cardioid and the backward facing cardioid have to be matched differently. Thus, the method explained in relation to the monaural hearing system may not only use a "speech from front" detector, but additionally or alternatively also a "speech from back" detector. Likewise, the method explained in relation to the binaural hearing system may have an additional or alternative output indicating signals from 180°±10° incidence direction controlling a second path within the level—and phase matching block for the two different cardioids.

An additional advantage of the method explained in relation to the binaural hearing system is that not only the two ipsi-lateral microphones can get matched when the true direction tDOA indicates a signal from the front and/or the back, but that the contra-lateral microphones can also get matched to the ipsi-lateral ones when a signal from the front or from the back are detected.

What is claimed is:

1. A method for adaptively matching microphones of a hearing system, the method comprising the steps of:

determining a true direction towards a sound source, determining an estimated direction towards the sound source using microphones of the hearing system, comparing the true direction with the estimated direction to obtain a correction factor, applying the correction factor to the signals of the microphones of the hearing system in order to reduce a difference between the true direction and a corrected estimated direction obtained via corrected microphone signals.

2. The method of claim 1, wherein the step of determining the true direction comprises limiting a first frequency range to a section in which a good matching of the microphones is expected, the first frequency range being above 1 kHz.

3. The method of claim 1, wherein the step of determining an estimated direction comprises limiting a second frequency range to a section in which the matching of the microphones is to be improved, the second frequency range being in particular below 1 kHz.

4. The method of claim 1, wherein the hearing system comprises a single hearing device with at least two microphones to be matched.

5. The method of claim 1, wherein the hearing system comprises a binaural hearing device with at least two microphones to be matched, and wherein an ipsi-lateral microphone and a co-lateral microphone are used in the step of determining the true direction.

6. The method of claim 5, wherein two ipsi-lateral microphones are used in the step of determining an estimated direction.

7. The method of claim 1, further comprising the step of checking whether a single sound source is present, particularly having at least a predefined signal-to-noise ratio and a predefined spectral range.

8. The method of claim 7, wherein a speech detector is used for determining the true direction of the sound source.

9. The method of claim 1, wherein all steps are performed during regular operation of the hearing system.

10. The method of claim 1, further comprising the step of storing the correction factor in a non-volatile memory in order to have access to the correction factor for initialization of the hearing system after boot-up.

11. A hearing system comprising:

at least two microphones generating input signals, means for determining a true direction towards a sound source, means for determining an estimated direction towards the sound source using at least two of the at least two microphones, means for comparing the true direction with the estimated direction to obtain a correction factor, means for applying the correction factor to the input signals of the microphones in order to reduce a difference between the true direction and a corrected estimated direction obtained via corrected input signals.

12. The hearing system of claim 11, wherein the means for determining the true direction comprise frequency limiting means for limiting a first frequency range to a section in which a good matching of the microphones is expected, the first frequency range being above 1 kHz.

13. The hearing system of claim 11, wherein the means for determining the estimated direction comprise frequency limiting means for limiting a second frequency range to a section in which the matching of the microphones is to be improved, the second frequency range being below 1 kHz.

14. The hearing system of claim 11, comprising a single hearing device with at least two microphones to be matched.

15. The hearing system of claim 11, comprising a binaural hearing device with at least two microphones to be matched, an ipsi-lateral microphone and a co-lateral microphone are used to determine the true direction.

16. The hearing system of claim 11, comprising two ipsi-lateral microphones to determine the estimated direction.

17. The hearing system of claim 11, further comprising means for checking whether a single sound source is present, particularly having at least a predefined signal-to-noise ratio and a predefined spectral range.

18. The hearing system of claim 11, comprising a speech detector for determining whether a single broadband sound source is present.

19. The hearing system of claim 11, comprising a non-volatile memory for storing the correction factor in order to have access to the correction factor for initialization after boot-up.

* * * * *